United States Patent [19]

Kindberg

[11] Patent Number: 4,819,400

[45] Date of Patent: Apr. 11, 1989

[54] BEAM AND METHOD FOR THE PRODUCTION THEREOF

[75] Inventor: Bengt A. Kindberg, Malmö , Sweden

[73] Assignee: Björn Larsson, Hestra, Sweden; a part interest

[21] Appl. No.: 940,766

[22] PCT Filed: Mar. 24, 1986

[86] PCT No.: PCT/SE86/00127

§ 371 Date: Jan. 7, 1987

§ 102(e) Date: Jan. 7, 1987

[87] PCT Pub. No.: WO86/05537

PCT Pub. Date: Sep. 25, 1986

[30] Foreign Application Priority Data

Mar. 22, 1985 [SE] Sweden ..... 8501413

[51] Int. Cl.[4] ..... E04C 3/00

[52] U.S. Cl. ..... 52/693; 52/729

[58] Field of Search ..... 52/749, 693, 694, 690; 411/456, 453, 454, 44, 55

[56] References Cited

U.S. PATENT DOCUMENTS

| | | | |
|---|---|---|---|
| 368,687 | 8/1887 | Rogers | 411/456 |
| 3,778,946 | 12/1973 | Wood et al. | 52/693 X |
| 4,069,635 | 1/1978 | Gilb | 52/693 |

FOREIGN PATENT DOCUMENTS

| | | |
|---|---|---|
| 857139 | 11/1952 | Fed. Rep. of Germany . |
| 1509023 | 3/1969 | Fed. Rep. of Germany . |
| 1659093 | 12/1970 | Fed. Rep. of Germany . |
| 2042890 | 5/1978 | Fed. Rep. of Germany . |
| 2367884 | 5/1978 | France . |
| 322613 | 4/1970 | Sweden . |
| 846599 | 8/1960 | United Kingdom . |

*Primary Examiner*—Carl D. Friedman

*Attorney, Agent, or Firm*—Beveridge, DeGrandi & Weilacher

[57] ABSTRACT

A beam having flanges (10, 11) of wood and a web interconnecting said flanges and consisting of metal rods (13) inclined relative to each other in the plane of the web like the bars in a trapezoidal curve and having end portions (14 and 15, respectively) bent in the same plane and at the same angle but in opposite directions and fixed in recessed bores (26) in the flanges (10, 11). Between the central portions and the end portions (14, 15) of the metal rods, washers (28) are accommodated in the recesses with close fit. The end portions (14, 15) are fixed either in blind bores (26) by engaging the wall of the bore, or in throughbores by means of a nut or the like engaging the end portion and abutting against the bottom of a recess of the end of the bore remote from the web. Preferably, the end portions (14, 15) are glued in their bores and the washers in their recesses. The beam is produced in that the flanges (10, 11) are provided with recessed bores at predetermined locations, washers are pressed into the recesses (27), and the end portions (14, 15) of the web-forming rods are inserted in their bores through the opening of the washers.

12 Claims, 6 Drawing Sheets

10
20
21
11
13

16
14
12
15
16
13
12
14
21
11
13
15
20
10
13
15
16
14
16

10
14
20
23
13

10
14
22
20
13

FIG. 9
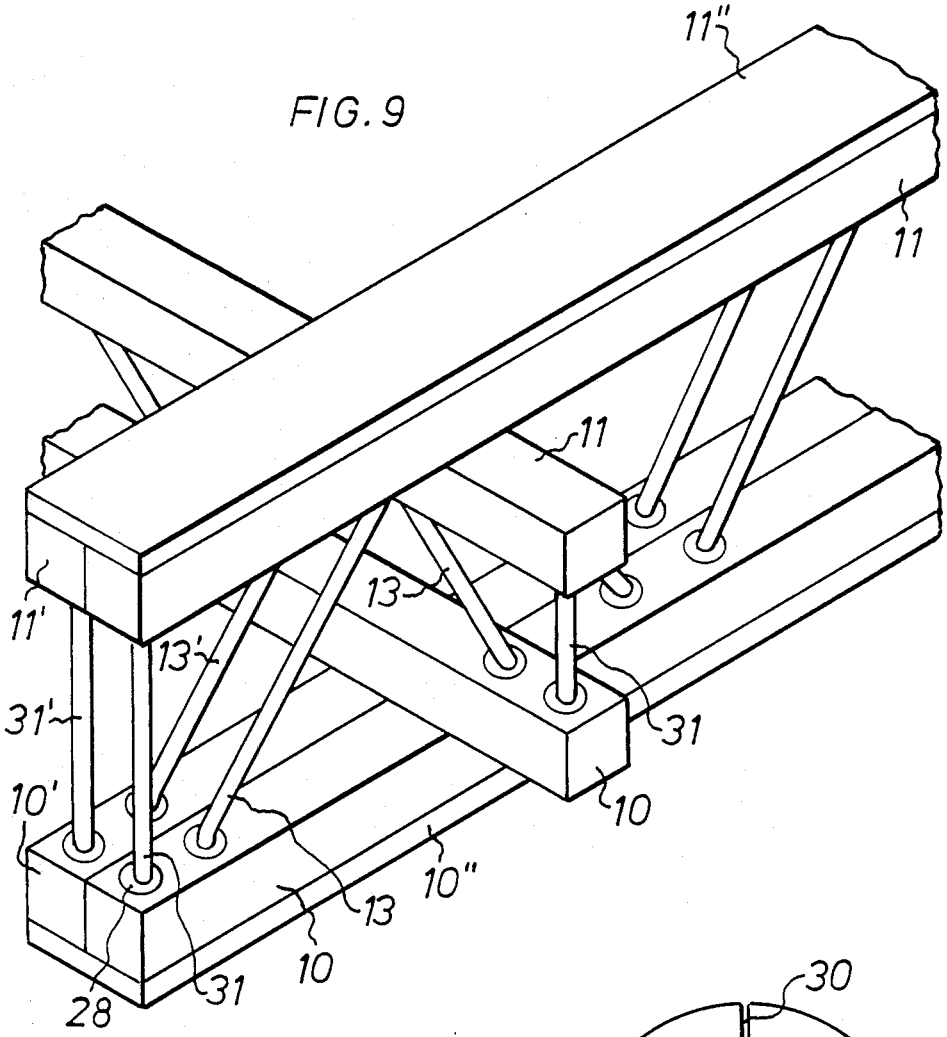
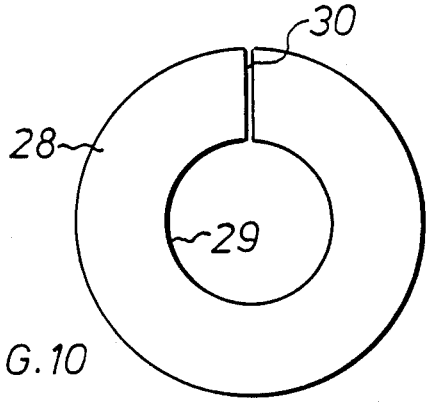
FIG. 10

BEAM AND METHOD FOR THE PRODUCTION THEREOF

The present invention relates to a beam comprising wooden flanges and a web interconnecting said flanges and consisting of metal rods inclined relative to each other parallel to the plane of the web like the bars in a trapezoidal curve.

Beams of this type are previously known in different embodiments. In one of these embodiments, the beam web is made of short metal pieces which have specially designed ends adapted to the flanges and connected thereto by means of bolts and/or corrugated joint fasteners. An example of such a beam is shown in DE-A No. 857,139. Such a beam is difficult to manufacture, and cost-effectiveness is possible only for large dimensions. Another beam has a metal web in the form of a zigzag or sinusoidally bent wire or rod whose turning points are enclosed in correspondingly shaped recesses between flange-forming ribs which are glued together. This is a considerably better solution where, although the web and the flanges are interconnected in a rational way, a good transmission of forces therebetween is obtained when the beam is used, and the beam may be manufactured at a profit also in smaller dimensions. However, one problem with this type of beam is that it can only be factory-made by means of a relatively complicated equipment. This also means that the beams are marketed but in few dimensions, which often entails that the construction in which the beam is used will be overdimensioned and thus unnecessarily expensive. Finally, attempts have been made to manufacture a beam of the last-mentioned type by gluing the turning points of the zigzag or sinusoidally bent wire in inwardly facing recesses of the beam flanges. However, to a person skilled in the art, it seems somewhat hazardous to use such a beam, since there is no mechanical joint between the web and the flanges, but only a glue joint which may easily break because of movements in the flanges and/or the web.

One object of the present invention is to provide a beam which has easily assembled members and which can readily be dimensioned for the current need. In principle, it should be possible even for a user who is not an expert to call on his supplier of building material and account for his needs, whereupon the supplier should be able, from simple tables, to determine the beam dimensions and furnish the material precisely required. By means of this material, the user will then be able readily to manufacture the beam or the beams on his own. Of course, this concept does not prevent the beam from being industrially manufactured in a rational and advantageous way be means of simple machines. This object is achieved in that the opposite end portions of each metal rod are bent and have a length which does not exceed the flange thickness, that a washer is provided at the transition between the central portion of the rod and the respective end portion, and that the end portions are secured in bores in the beam flanges with the washer accommodated with close fit in a recess around the bore.

The invention further relates to a method for producing a beam comprising wooden flanges and a web interconnecting said flanges and consisting of metal rods inclined relative to each other parallel to the plane of the web like the bars in a trapezoidal curve. This method is characterised in that bores with recesses are provided at predetermined intervals in elongate pieces of wood forming the flanges, that washers of plastic or metal having a central opening are applied in said recesses, and that end portions of the metal rods which are bent bent in the same plane and at the same angle but in the opposite directions are pressed through said washers and into the bores. The beam webs can be produced in a rational way in that rods are bent into a trapezoidal curve having straight parallel portions alternating with inclined ones, that the bent rods are disposed with corresponding formations in the transverse direction opposite one another but in "antiphase", that straight parallel wires, bars or strips are disposed transversely of the positioned bent rods over the points of transition between the straight portions and the inclined portions of the rods, that said wires, bars or strips are connected to the bent rods by spot welding or the like, that the resulting net is divided into beam web-forming "lengths" by cutting off the straight portions of the bent rods midway between the ends of said portions, said lengths each consisting of two parallel wires, bars or strips having between them inclined rod-forming portions and on their outer sides protruding straight pin-forming portions.

The invention will be described in greater detail hereinbelow with reference to the accompanying drawings showing various embodiments.

FIG. 9 is a perspective view showing how beams according to the invention can be combined for supporting e.g. sheathing or producing a building structure.

FIG. 10 shows a washer.

Figure 1:
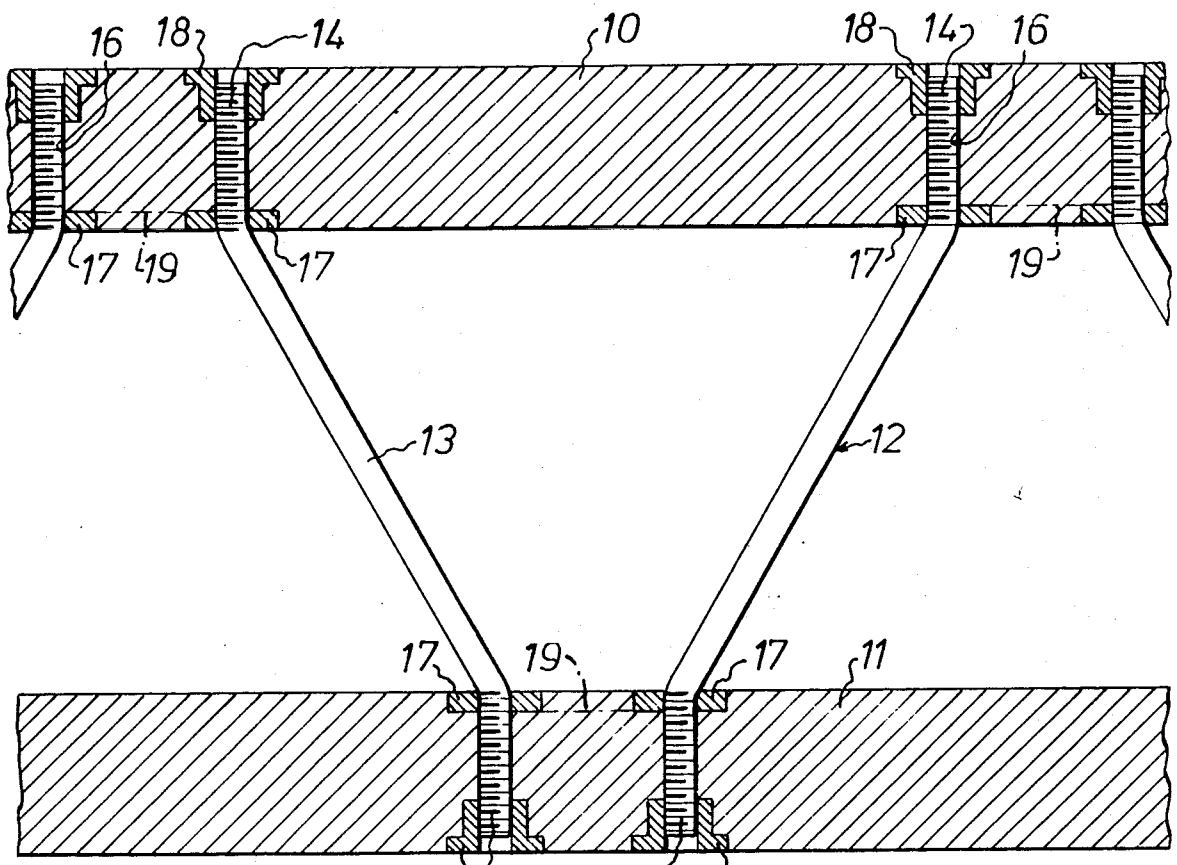
FIG. 1 is a longitudinal section of a portion of a beam produced in accordance with the invention.

The beam in FIG. 1 consists of flanges 10, 11 of wood. The flanges may either consist of battens in one piece or be laminated and may, if so required, have some type of reinforcement. If so desired or required, the flanges may be finger-jointed. Between the flanges 10, 11, there is provided a beam web 12 which consists of a number of metal rods 13 having end portions 14 and 15, respectively, which are bent in the same plane and at the same obtuse angle but in opposite directions. The end portions 14, 15 are disposed in bores 16 drilled in the flanges 10, 11. In order to limit the depth of insertion of the end portions 14, 15 in the flanges 10, 11 and, above all, to improve the connection between these portions and the flanges, a washer 17 is provided at the transition between the rods 13 and the end portions 14, 15. The washer is accommodated in a recess surrounding the bore 16. The end portions 14, 15 have a length which does not exceed the flange thickness so as not to protrude on the outer side of the flanges 11 and detract from the usefulness of the beams. In the embodiment according to FIGS. 1 and 2, the end portions 14, 15 are threaded to permit being secured by means of nut-like means 18 which can be screwed on the end portions 14, 15 from the outer side of the flanges 10, 11. Suitably, the nut-like means 18 have the form of a washer with a threaded central opening around which an internally threaded collar extends. In order to obtain a smooth outer side of the flange, the bore 16 is suitably provided with an external recess and to prevent the appearance of heat bridges, the recess may have a depth exceeding the height of the means 18, such that the outwardly facing surface thereof, after tightening on the end portion 14, 15, is located some distance inwardly of the outer surface of the flange.

Figure 2:
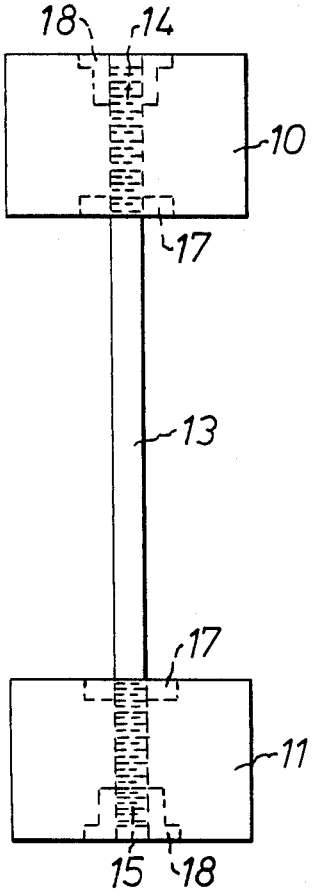
FIG. 2 shows the beam in FIG. 1 from one end thereof.

A beam of the type shown in FIGS. 1 and 2 is readily produced in that the wooden flanges 10, 11 are first bored, preferably by a template, and provided with the necessary recesses for the fixing means 18 and for the washers 17 on the inner side of the flanges 10, 11. For mounting the rods 13, the pins 14, 15 are inserted in the associated bores, and the means 18 are tightened such that the wood material of the flange adjacent the bores is clamped between the washers 17 and the means 18. For tightening the means 18, recesses or holes may be provided in the outwardly facing side of the means.

When the expert or the ordinary user wishes to make a beam, he preferably contacts his supplier of building material and specifies his wishes as to beam strength, beam length etc. On the basis of tables, the suppier can then readily establish the appropriate dimensions and supply them from his stock. The set of material supplied may also include a drilling template for drilling the flanges 10, 11, or the supplier may lend such templates to the customer. The expert or ordinary user may then simply take the parts home and make the beam on the building site by providing the flanges 10, 11 with, for example, the pairs of bores shown in FIG. 1, whereupon the end portions 14, 15 of the rods are inserted in the associated bores such that the rods 13 between the flanges 10, 11 form the pattern of bars in a trapezoidal curve in the manner shown in FIG. 1. After the threaded means 18 have been tightened, the beam is ready for use.

The distance between the web-forming rods 13 need of course not be that shown in FIG. 1—at expected lower loads on the beam, the distance between the rods can be increased in accordance with the supplier's instructions. In FIG. 1, each rod further comprises a washer 17 at its opposite ends, but with respect to force transmission, it is possible to use a single washer for two adjacent end portions 14, 14 and 15, 15, respectively, as indicated at 19.

Figure 8:
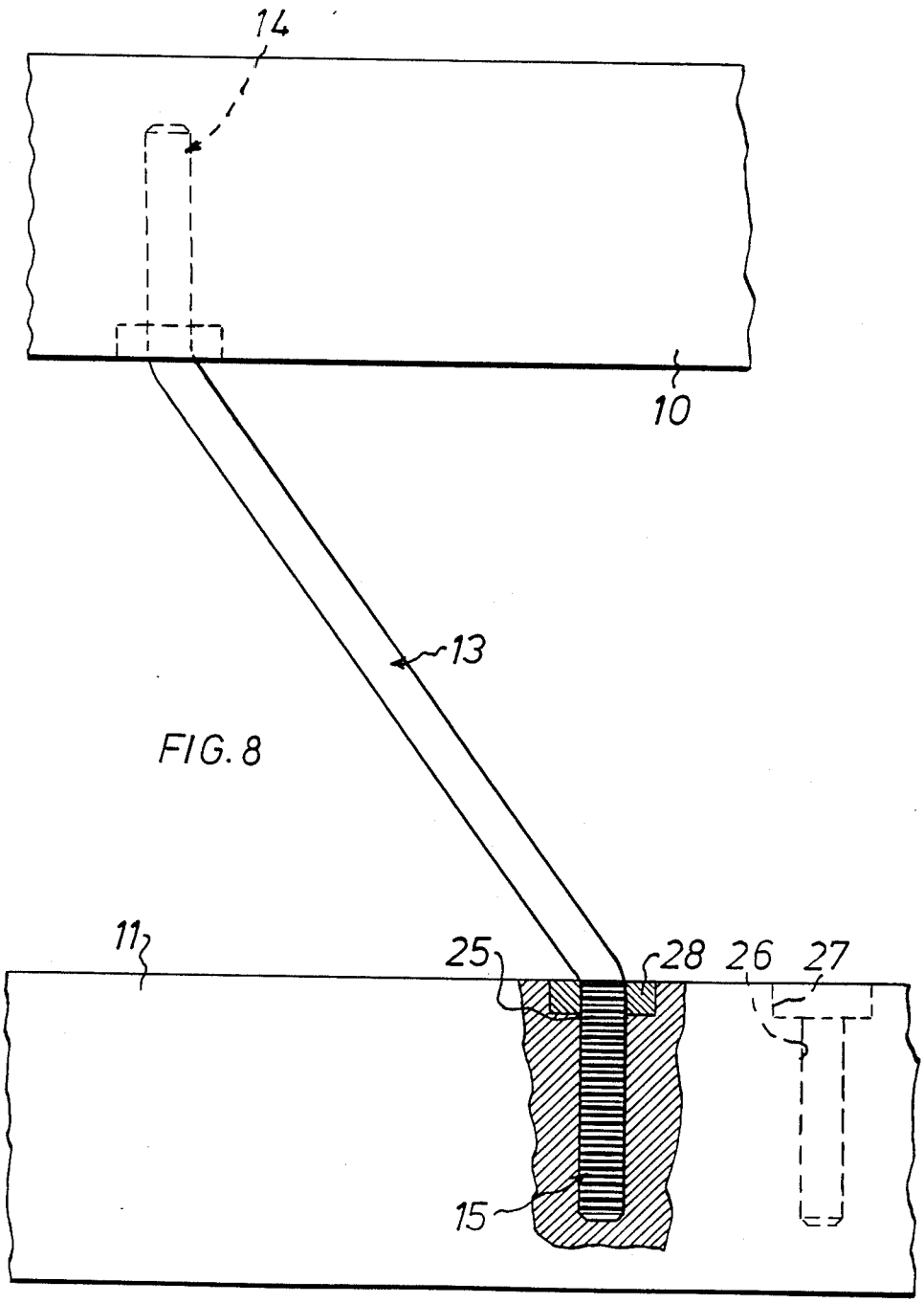
FIG. 8 is a sectional view showing another embodiment of the beam.

While the web 12 in FIGS. 1 and 2 is well suited for manual production of beams, the embodiment in FIG. 8 is specially developed for industrial production, although manual production is by no means excluded. As in the former case, the end portions 14, 15 of the web-forming rods 13 may be threaded but preferably have raised gill-like portions or ridges 25 around the periphery. In order to anchor the end portions 14, 15 of the rods 13 in the flanges 10, 11, bores 26 are provided at predetermined intervals in one side of the flanges. As appears from FIG. 8, these bores are blind bores and have a recess 27 of predetermined diameter. The bores 26 are so dimensioned that the end portions 14, 15 can be pressed into them with a predetermined friction or engagement with the wall of the bore.

In the manufacture of a beam of the embodiment indicated in FIG. 8, a washer 28 is first applied in the recess 27, which washer 28 has a thickness corresponding to the depth of the recess 27. The washer 28, which is shown from above in FIG. 10, has an inner opening 29 of a diameter which is slightly smaller than the outer diameter of the end portions 14, 15, and a slot 30 between the outer periphery and the inner periphery. The washer 28 can be pressed into the recess 27 in order, with a certain friction, to engage the peripheral wall of the recess 27 and, suitably, a small amount of glue is applied in the recess 27 before the washer 28 is placed therein. The washer 28 may be of metal but is preferably made of a suitable plastic material. With the washer in place, the bent end portions 14, 15 of the rod 13 are pressed into the bores 26, suitably after a predetermined amount of glue has been applied therein. For introducing the end portions 14, 15 in the bores 26, they are pressed through the washer and since the opening 29 thereof has a diameter which is smaller than the outer diameter of the end portions, the washers 28 will be expanded and a very solid engagement between the periphery of the washer 28 and the material of the flange is achieved. The end portions 14, 15 engage the wall of the bore with their peripheral ridges. It is very easy to press the end portions 14, 15 into the associated bores 26, for which reason the mechanical equipment therefor is simple and inexpensive. The beam thus produced has very good physical properties.

Figure 3:
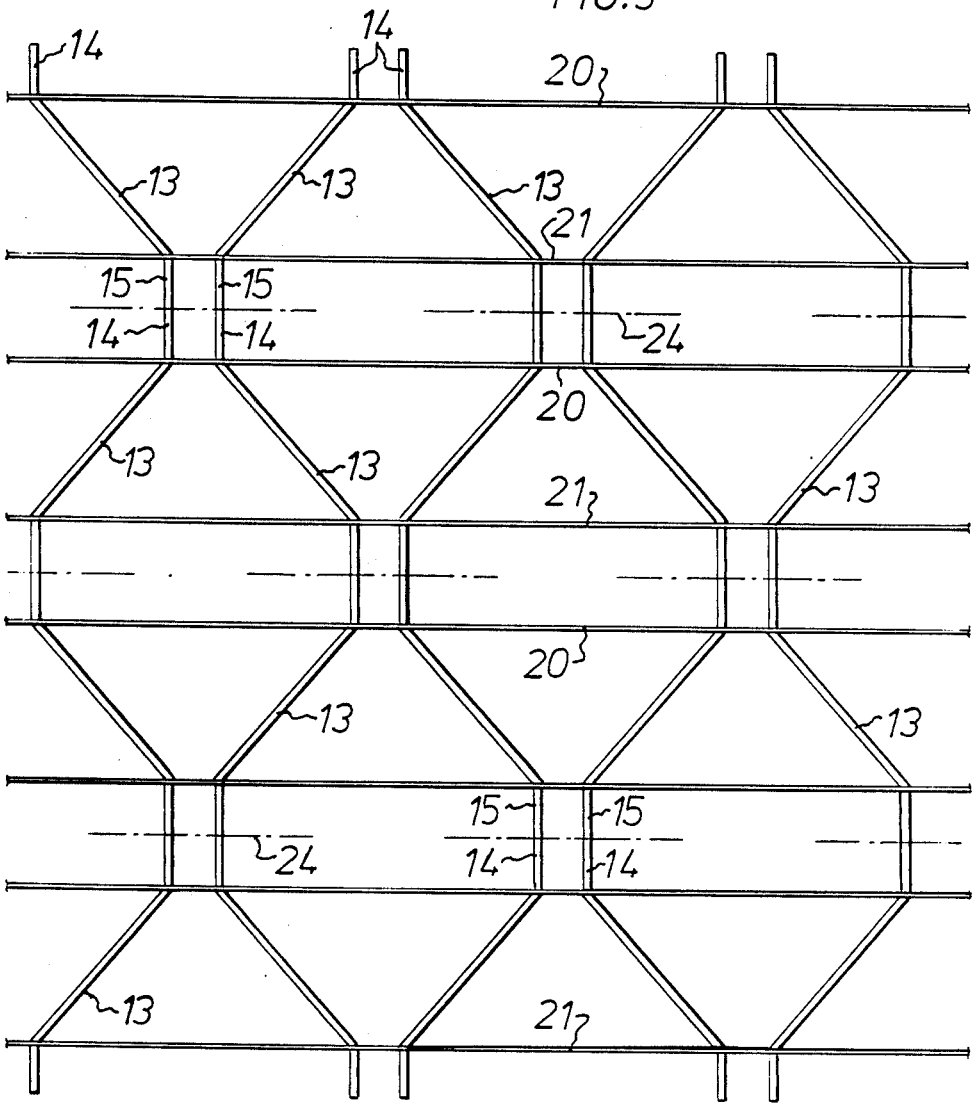
FIG. 3 illustrates from above how metal webs for beams according to the invention are provided in a rational way.
Figures 4, 5, 6, 7:
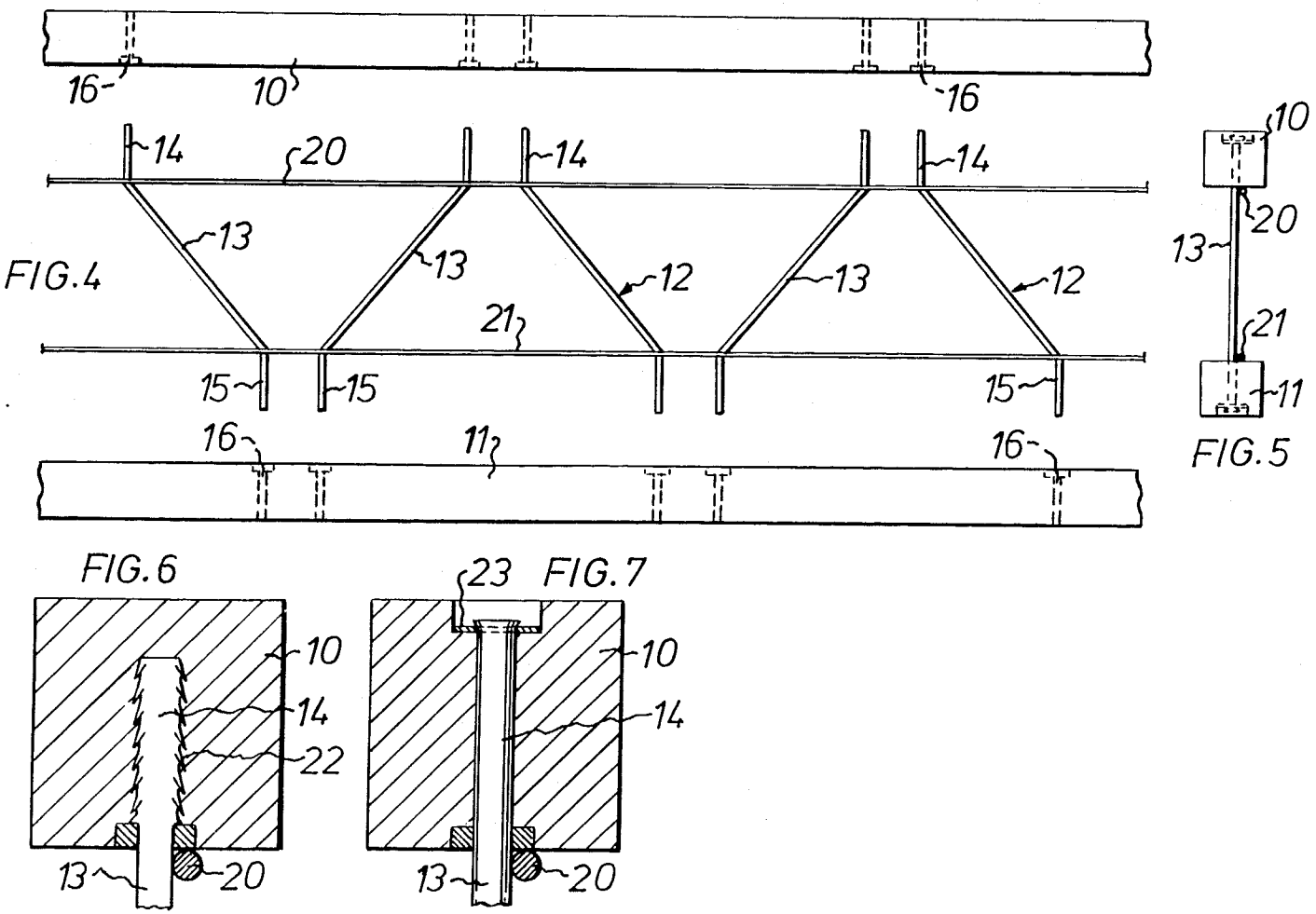
FIG. 4 shows, with slightly separated parts, how a beam having a web of the type shown in FIG. 3 is produced.
FIG. 5 shows a beam produced from the parts in FIG. 4.
FIG. 6 shows an example of how a pin can be secured in the associated flange.
FIG. 7 shows a further example of how the pin can be secured in the flange.

FIGS. 1, 2 and 8 illustrate a beam having a web 12 which consists of separate members. FIGS. 3–5 show another type of web in which the rods 13 are coherent and which confers the advantage of permitting very rational manufacture. Thus, the production of the web is so carried out that a number of rods are bent into the shape of a trapezoidal curve having straight parallel portions 14, 15 alternating with inclined ones (FIG. 3). A number of rods thus bent are placed on a supporting surface with corresponding curve formations in the transverse direction opposite one another but with adjoining curves in "antiphase". Then, bars, wires or strips 20, 21 are placed transversely of the laid-out trapezoidally bent rods over the points where straight portions merge into inclined ones, and the bars etc. 20, 21 are connected by spot welding to the trapezoidally bent rods. In this way, the net shown in FIG. 3 is obtained. Then, this net is divided into lengths by cutting it off along the dash-dot lines 24. As appears, this gives coherent webs consisting of two parallel bars, wires or strips 20, 21 having between them the inclined rods 13 and on their outer sides the protruding end portions 14 and 15, respectively. The production of the net according to FIG. 3 and the division thereof into lengths may of course be carried out manually but is primarily intended to be performed in a machine. After the cutting into lengths, the end portions 14, 15 can be machined, i.e. be threaded or provided with circumferential ridges or barbs 22 (FIG. 6), and are thereafter introduced via washers 28 in recessed bores 26 in the manner described with reference to FIG. 8. It is also possible to use smooth end portions 14, 15 which are anchored in throughbores, preferably after coating with glue, by upsetting the free end of the end portion against a washer 23 in a recess in the outwardly facing side of the flange (FIG. 7). If so desired, the bores for the end portions 14, 15 in the flanges may be provided with a reinforcing sleeve of plastic or metal.

FIG. 9 illustrates an easy mode of combining beams according to the invention for producing desired structures, in the instant case a beam arrangement for supporting sheathing. As appears, a first beam with flanges 10, 11 and rods 13 forming the beam web is connected parallel to a corresponding beam having flanges 10', 11' and web-forming rods 13'. It appears from FIG. 9 that, when suitable, it is also possible to use rods 31 (31') which extend at right angles to the flanges 10, 11 and are anchored in the flanges 10, 11 in the same manner as the rods 13. The flanges 10, 10' and 11, 11' engage each other along one of their side faces and, on the outer faces of the flanges 10, 10' and 11, 11' which are facing away from each other, sheet members, preferably strips 10'', 11'' of plywood, are secured by gluing, nailing or a combination thereof. Also the sides of the flanges 10, 10'; 11, 11' are preferably interconnected by gluing. As is obvious, additional beams according to the invention can be disposed between the flanges 10, 10' and 11, 11' with their flange surfaces which are facing away from each other engaging the mutually facing flange surfaces of the first-mentioned beams. The inner beams of course extend between the space between the points of connection of consecutive rods in the flanges 10, 10' and 11, 11'. It will be understood that beams according to the invention, which can easily be obtained in many different dimensions, can be used for producing many different types of constructions complying with widely different needs.

It appears from the foregoing that the invention makes it possible in a simple and rational manner to produce suitably dimensioned beams. A specific advantage offered by the beam according to the invention, as opposed to beams having a web in one piece bent in zigzag, is that it is easy to cut between two adjacent end pieces. Although only straight beams are shown in the drawings, it is possible without any difficulties to produce, for instance, beams having a decreasing web height, a curved upper flange 10 for vaulted roof surfaces etc., by using metal rods 13 of decreasing length. The invention therefore is an important technical improvement by allowing simple, rational manufacture of beams suited for the specific uses.

I claim:

1. A beam comprising flanges of wood and a web interconnecting said flanges, said flanges having blind bores therein and having recesses which extend around said bores, said web being formed of metal rods inclined relative to each other in the plane of the web like the bars in a trapezoidal curve, characterized in that the opposite end portions of each metal rod are bent in the same plane and at the same angle but in opposite directions and have a length which is less than the flange thickness, that a washer is provided at the transition between the central portion of the rod and each end portion, and that the end portions are secured in said blind bores in the beam flanges with the washer accommodated with close fit in a recess around the bore, said end portions being provided with circumferential flanges or ridges and being secured in their bores by means of said circumferential flanges or ridges engaging the walls of the bores.

2. Beam as claimed in claim 1 characterised in that the washer 17 at the transition between the central portion of the rod and the end portions 14, 15 thereof is common to two adjoining end portions 14, 14; 15, 15.

3. Beam as claimed in claim 1, characterised in that the end portions 14, 15 are secured in their bores by means of glue.

4. Beam as claimed in claim 1, characterised in that the central openings of the washers have a smaller diameter than the end portions, said washers being secured in their recesses by means of glue.

5. Beam as claimed in claim 1, characterised in that the washers 28 are secured in their recesses 27 by means of glue.

6. Beam as claimed in claim 1, characterised in that the rods 13 are rigidly interconnected adjacent the transition between the central portion 13 of the rod and the end portions 14, 15 by means of bars or strips extending parallel to the flanges 10, 11.

7. A method for the production of a beam having flanges formed of elongate pieces of wood and a web interconnecting said flanges, said web being formed of metal rods inclined relative to each other parallel to the plane of the web like the bars in a trapezoidal curve, characterized in that at least two bores with two respective recesses extending thereabout are provided at predetermined intervals in said elongate pieces of wood forming the flanges, that washers of plastic or metal having a central opening are applied in said recesses, and that end portions of the metal rods which are bent in the same plane and at the same angle but in opposite directions are pressed through said washers and into said bores, each of said washers having a radial slot and a central opening which has a smaller diameter than the end portion received therein such that the washers are pressed into solid engagement with the periphery of the recesses when the end portions are pressed therethrough.

8. Method as claimed in claim 7, characterised in that the washers (28) have a radial slot (30) and that their central openings (29) have a smaller diameter than the end portions (14, 15) such that the washers are pressed into solid engagement with the periphery of the recesses (27) when the end portions (14,15) are pressed therethrough.

9. Method for producing a beam comprising flanges 10, 11 of wood and a web 12 interconnecting said flanges and consisting of metal rods 13 inclined relative to each other in the plane of the web like the bars in a trapezoidal curve, characterised in that rods are bent into a trapezoidal curve having straight, parallel portions alternating with inclined ones 13, that the bent rods are disposed with corresponding formations in the transverse direction opposite one another but with adjoining formations in "antiphase", that straight parallel wires, bars or strips 20, 21 are disposed transversely of the positioned bent rods over the points of transition between the straight portions 14, 15 and the inclined portions 13 of the rods, that said wires, bars or strips 20, 21 are connected to the bent rods by spot welding or the like, that the resulting net is divided 24 into beam web-forming "lengths" by cutting off the straight portions 14, 15 of the bent rods midway between the ends of said portions, said lengths each consisting of two parallel wires, bars or strips 20, 21 having between them inclined rod-forming portions 13 and on their outer sides protruding straight end portions 14 and 15, respectively, that wood battens forming the beam flanges 10, 11 are provided with recessed bores 16 for receiving the straight end portions 14, 15, that washers 28 are pressed down into the recesses, and that the end portions 14, 15 are pressed into their bores until the straight parallel wires, bars or strips 20, 21 engage the inner side of a respective flange-forming batten.

10. Method as claimed in claim 9, characterised in that the end portions 14, 15 are machined, e.g. formed with barbs 22 or circumferential ridges 25, threaded etc. before being pressed into said bores.

11. A beam comprising flanges of wood and a web interconnecting said flanges, said flanges having bores therein, said web being formed of metal rods inclined relative to each other in the plane of the web like the bars in a trapezoidal curve, characterized in that the opposite end portions of each metal rod are bent in the same plane and at the same angle but in opposite directions and have a length which does not exceed the flange thickness, that a washer is provided at the transition between the central portion of the rod and each end portion, and that the end portions are secured in said bores in the beam flanges with the washers accommodated with close fit in recesses around the bores, each said washer having a central opening which has a smaller diameter than the end portion, said washer having a radial slot extending from its outer periphery to the central opening, said end portions being provided with circumferential flanges or ridges and secured in their bores by means of said circumferential flanges or ridges engaging the walls of the bores.

12. A beam comprising flanges of wood and a web interconnecting said flanges, said flanges having bores therein, said web being formed of metal rods inclined relative to each other in the plane of the web like the bars in a trapezoidal curve, characterized in that the opposite end portions of each metal rod are bent in the same plane and at the same angle but in opposite directions and have a length which does not exceed the flange thickness, that a washer is provided at the transition between the central portion of the rod and each end portion, and that the end portions are secured in said bores in the beam flanges with the washers accommodated with close fit in recesses around the bores, each said beam having bars or strips which extend parallel to the flanges, said bars or strips rigidly interconnecting said rods adjacent the transitions between the central portions of the rods and the end portions thereof, said end portions being provided with circumferential flanges or ridges and being secured in their bores by means of said circumferential flanges or ridges engaging the walls of the bores.

* * * * *